455-613
10/12/82
AU 233 EX
XR 4,354,278

United States Patent [19]

Clark et al.

[11] 4,354,278

[45] Oct. 12, 1982

[54] LASER TELEMETRY

[75] Inventors: Lee K. Clark, Santa Ana; Michael C. Peron, Diamond Bar, both of Calif.

[73] Assignee: Northrop Corporation, Hawthorne, Calif.

[21] Appl. No.: 214,970

[22] Filed: Dec. 10, 1980

[51] Int. Cl.[3] ..... H04B 9/00

[52] U.S. Cl. ..... 455/617; 340/870.18; 340/870.26; 340/870.28; 455/608; 455/613

[58] Field of Search ..... 455/608, 609, 611, 613, 455/615, 617; 340/870.18, 870.26, 870.28, 870.29

[56] References Cited

U.S. PATENT DOCUMENTS 3,623,045 11/1971 Ouellette ..... 340/870.28
4,119,913 10/1978 Everswick ..... 340/870.18
4,190,362 2/1980 Dubrunfaut ..... 356/5

*Primary Examiner*—Howard Britton
*Attorney, Agent, or Firm*—William W. Rundle; John E. Peele, Jr.

[57] ABSTRACT

A projectile carries a laser transmitter which directs its output beam to the rear through an aperture in the projectile. The beam is coded (modulated) in accordance with the start or stop of events or flight conditions being monitored by one or more transducers in the projectile. The beam is initially pulsed at a known reference rate from a thermal battery automatically activated by the launching acceleration of the projectile. Thus, occurrence of an event or condition will change the laser frequency to a new predetermined rate. The beam can be decoded at a receiving station in the vicinity of the launching site.

10 Claims, 5 Drawing Figures

LASER TELEMETRY

BACKGROUND OF THE INVENTION

1. Field of the Invention

The present invention relates to telemetering systems, and more particularly, to a low cost laser telemetry system for transmitting information from a fired projectile back to ground or other launching stations.

2. Description of the Prior Art

Conventional telemeter systems utilize high frequency radio waves, antennas, and a variety of complex electronic hardware both in the tracked and/or measured vehicle and on the ground. Such systems are expensive and relatively heavy and undesired for a tank-fired projectile for example.

U.S. Pat. No. 3,623,045 to Ouellette discloses an internal gun-tube ballistics laser telemeter affixed in a projectile for measuring component performance during the time of actual firing while still in the gun tube. The pulsed laser beam travels through an opening in the nose of the projectile and is reflected to a ground station receiver by a mirror mounted in spaced relationship to the muzzle of an artillery piece.

U.S. Pat. No. 4,190,362 to Dubrunfaut discloses a pulsed laser beam reflected back from a target whose range is being measured. This reflected beam is processed and combined with the transmitted beam by remote ranging apparatus.

SUMMARY OF THE INVENTION

It is an object of this invention to provide a high-g, low cost laser telemetry system capable of providing real-time information from a tank-fired projectile or other flight vehicle, while in flight, back to the ground or other firing site.

Briefly, our invention comprises a laser beam generator transmitting a beam backward from a projectile (or other vehicle) to a receiver at a launching site. The generator is controlled to code the laser beam in accordance with the desired performance information of the projectile flight. An electrical power supply for the telemeter system is preferably automatically activated by the launch operation which then activates the system.

DESCRIPTION OF THE PREFERRED EMBODIMENTS

Figure 1:
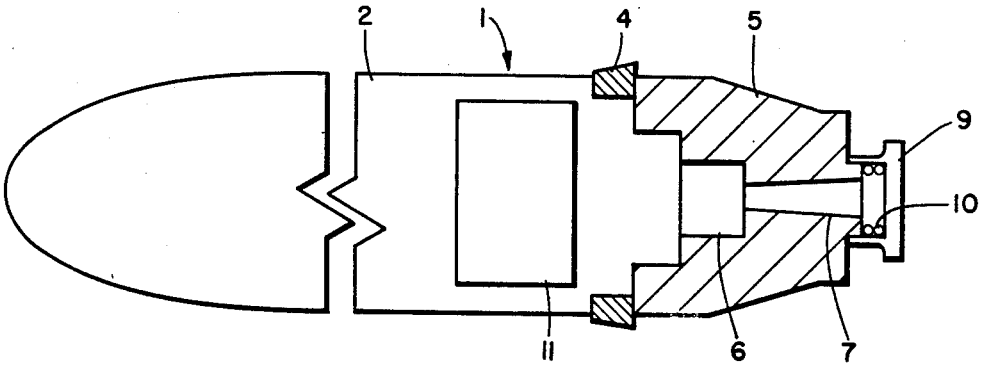
FIG. 1 is an elevation diagram, partly in section, of a gun-fired projectile, showing the location of the present laser telemeter invention therein.

Referring first to FIG. 1 for a description of a particular example of apparatus embodying the present invention, a cannon-launched projectile 1 includes a main body 2 having an obturator 4 near the rear thereof. Back of the obturator 4 is a boat-tail assembly 5 which may have folding fins (not shown) pivoted thereon. This boat-tail assembly 5 houses a telemeter system 6 to be described, near the forward end, and a central beam passage 7 extends from the telemeter system 6 to a rear opening in the tail of the projectile. The passage 7 tapers wider toward the rear.

A removable cover 9 fits over the passage 7 on the rear end of the tail assembly 5. This cover protects the telemeter system components from the high pressure explosive charge during firing of the projectile 1 as it is being accelerated in the barrel or tube of the cannon. The cover 9 falls away when the projectile 1 leaves the tube, and it is preferably biased as by a spring 10, for example, to cause such operation, as is well known in other applications.

Figure 2:
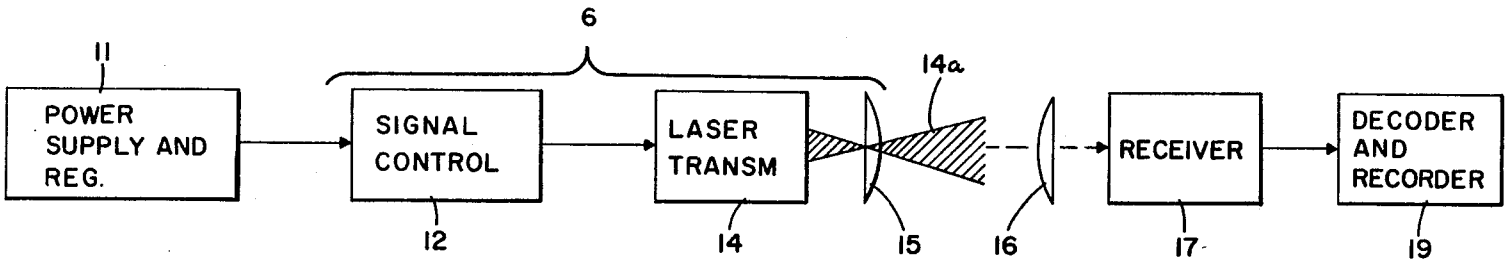
FIG. 2 is a block diagram of the overall telemeter transmitter and a remote receiver.

An electrical power supply 11, and usually a regulator, is provided in the main body 2 of projectile 1, which power supply is customarily a part of present-day missiles. The telemeter system 6 (FIG. 2) is energized by power supply 11 and comprises, in general, a signal control 12, or modulator, and a laser transmitter 14 connected to the output of the modulator. Laser transmitter 14 produces a beam **14*a* which is projected rearly from the passage 7 by a suitable collimating lens 15. The beam 14*a*** preferably diverges at an angle from 2 degrees to 10 degrees, for example, or whatever is necessary for the particular application.

At or near the cannon location, or other projectile firing site as the case may be, a receiver installation is provided. This comprises, in general, a collecting lens 16 for the transmitted laser beams, a receiver 17, and a decoder 19 for demodulating and recording the telemetered information, for example. The receiving installation is not a part of the present invention and need not be described in detail.

Figure 3:
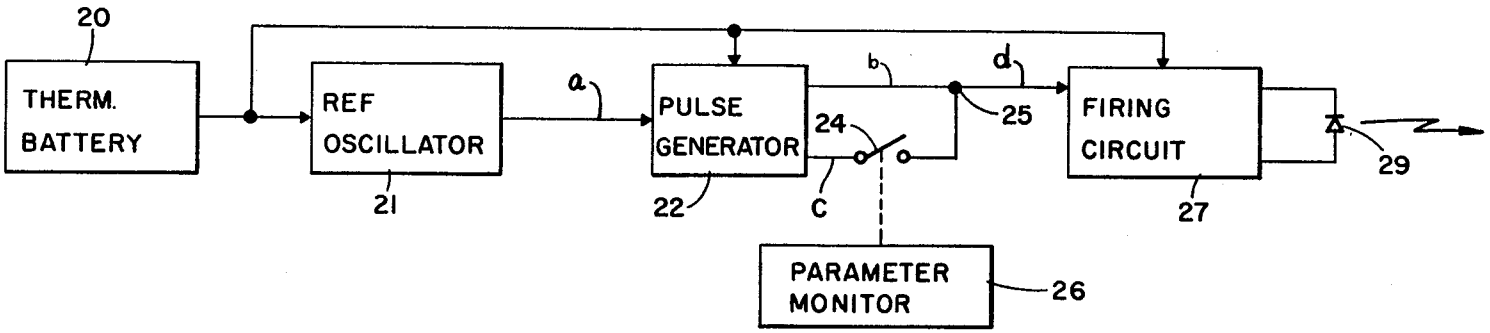
FIG. 3 is a detailed block diagram of one specific embodiment of modulator system for the laser beam.

One particular telemeter system is shown in FIG. 3. The power supply comprises a conventional thermal battery 20 which is activated automatically by the high acceleration shock of firing the projectile 1. The rise of battery output voltage to rated amount starts a reference oscillator 21 which produces square output pulses at a steady rate as shown on line "a" of FIG. 5 for example. Connected to the output of oscillator 21 is a pulse generator circuit 22 having two outputs, as shown on lines "b" and "c", respectively, of FIG. 5. The "b" output is one complete pulse generated by the leading edge of each reference pulse "a" at the input of pulse generator 22. The "c" output is one complete pulse generated by the trailing edge of each reference pulse "a". The locations of the pulse signals a, b, etc., are also shown on the block diagram of FIG. 3.

An on-off control switch 24 or gate is connected in the "c" line, and the output side of switch 24 is connected to the "b" line at a junction 25 which may comprise a mixer which functions as an adder. This makes the output line "d" from the junction 25 carry a pulse train represented by "b+c" as illustrated on line "d" of FIG. 5.

The control switch 24 is operated by a parameter monitor 26 which is responsive to occurrence of some event which is desired to be signalled by this system. This event may of course be any of countless conditions or happenings which a predetermined transducer is set to record, such as the attainment of a specific flight performance figure, the sighting of a certain object by a tracking system, the position of a control element, and so on.

Figure 5:
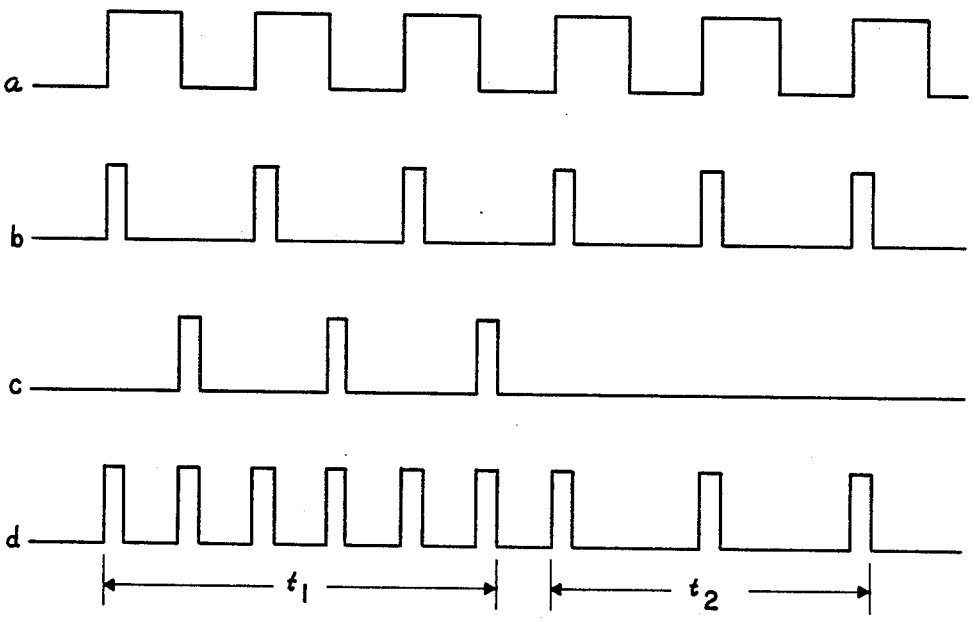
FIG. 5 is a waveform diagram used in explaining the operation of the system of FIG. 3.

The pulses on line "d" of FIG. 5 are fed to a laser firing circuit 27 which controls the triggering current to a laser, such as a GaAs laser diode 29. Each electrical pulse produces one laser pulse. The laser pulses are beamed by the collimating lens 15 substantially directly to the rear of the projectile 1 through the passage 7 in this system.

Upon firing of the projectile, the thermal battery 20 is activated to start the reference oscillator 21. Operation of the circuit as previously described will thus result in the sending and receiving of laser beam pulses at a frequency represented by "b". This will indicate that the telemetry system is functional but the condition to be monitored by control switch 24 is not present. Whenever during the flight that such condition occurs, laser beam pulses at the frequency "b+c" will be telemetered. This is a simple system, wherein the signal appearing on line "d" of FIG. 5 indicates that during a time period $t_1$ the control switch 24 is closed, and that during a time period $t_2$ the switch 24 is open but the power supply (battery 20), reference oscillator 21, pulse generator 22, firing circuit 27 and laser 29 are operating, a fact that is useful in analysis. (Signal "b" is analogous to a carrier signal in an amplitude modulated radio wave). In this particular instance, one of the two possible telemetered frequencies is twice the other, which makes them easily distinguishable. But other types of pulse code modulation or pulse position modulation may obviously be employed.

Figure 4:
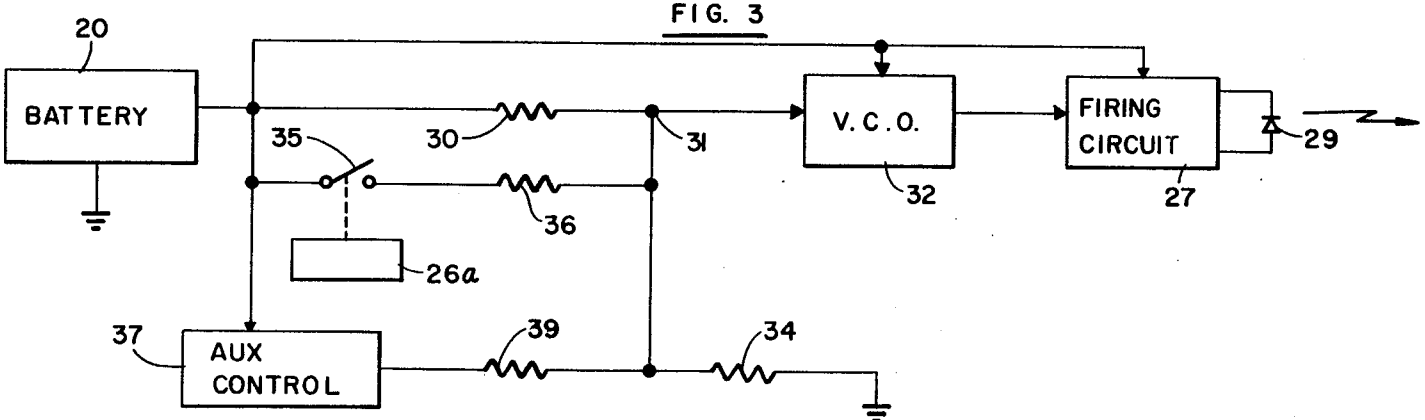
FIG. 4 is a detailed block diagram of another, more general, embodiment of laser beam modulator.

Further, more than one or two parameters or events can be handled by this laser telemeter invention. To illustrate, a more general type of system embodiment is shown in FIG. 4. Here, the battery 20 is connected through a first control resistance 30 to the input point 31 of a voltage controlled oscillator 32, with an input load resistance 34 also connected from the input point 31 to ground. A parameter switch 35 and second control resistance 36 are connected in parallel with the first control resistance 30. The parameter switch 35 is operated by another parameter monitor **26*a* like the arrangement in FIG. 3**.

An auxiliary control 37 is representative of additional transducers or monitors which can telemeter predetermined desired flight information of an essentially on-off nature. The auxiliary control 37 is also powered by the battery 20 and has a signal output connected through a third control resistance 39 to the V.C.O. input point 31. The control resistances 30, 36, and 39 have different given resistance values so that the various combinations of inputs will result in different, identifiable, frequencies of the voltage controlled oscillator 32. The laser firing circuit 27 is connected to the output of the voltage controlled oscillator 32 and functions as before in triggering the laser beam pulses.

Our invention is not restricted to use with only strictly ballistic projectiles like a bullet, for example. With suitable modifications such as pop-out or off-center laser beam transmission elements, this system can be made to operate from a rocket or the like. Therefore, the word "projectile" in this specification and claims is understood to include all such vehicles.

It is thus seen that a unique laser telemetry system has been provided to transmit information in real time from a flight vehicle back to a ground based receiver. If none of the parameter monitors are "on", there is still a reference frequency being sent to indicate operation of the telemetry system. Both the telemeter transmitter and receiver are simple low-cost items. As compared to a radio frequency (RF) telemetry system, there are many advantages to the present invention, which include a proven 26,000 "G" ruggedized design at greater than a tenfold cost savings over comparable RF telemetry systems.

While in order to comply with the statute, the invention has been described in language more or less specific as to structural features, it is to be understood that the invention is not limited to the specific features shown, but that the means and construction herein disclosed comprise the preferred mode of putting the invention into effect, and the invention is therefore claimed in any of its forms or modifications within the legitimate and valid scope of the appended claims.

What is claimed is:

1. A telemetry system in a vehicle adapted to be launched, comprising:

(a) means defining an aperture in the rear of said vehicle for passage of a laser beam therethrough;

(b) laser means in said vehicle and means for projecting a beam from said laser through said aperture;

(c) means for pulsing said laser at a first frequency when said system is energized with operating power in the absence of a desired vehicle parameter condition; and (d) means for pulsing said laser at a second frequency when said system is energized with said operating power in the presence of said parameter condition.

2. Apparatus in accordance with claim 1 including means for energizing said system with said operating power at the time of launch of said vehicle.

3. Apparatus in accordance with claim 1 including removable protective cover means over said aperture at the time of said launch.

4. A telemetry system in a vehicle, comprising:

(a) means defining an aperture in the rear of said vehicle for passage of a laser beam therethrough;

(b) laser means in said vehicle and means for projecting a beam from said laser through said aperture;

(c) means for pulsing said laser at a first frequency in the absence of a desired vehicle parameter condition; and (d) means for pulsing said laser at a second frequency in the presence of said parameter condition.

5. Apparatus in accordance with claim 4 wherein said means for pulsing said laser at said second frequency comprises means for adding a laser pulse essentially midway between the laser pulses of said first frequency.

6. Apparatus in accordance with claim 4 wherein said means for pulsing said laser at said second frequency comprises a parameter monitor having a first position in the absence of said parameter condition and a second position in the presence of said parameter condition, and means resonsive to said second position of said monitor for adding a laser pulse essentially midway between the laser pulses of said first frequency.

7. Apparatus in accordance with claim 4 including a voltage controlled oscillator having an output connected to pulse said laser in accordance with the frequency of said voltage controlled oscillator, means for producing a normal reference input voltage to said oscillator, and parameter monitor transducer means connected to said input voltage producing means to change said input voltage in the presence of said condition.

8. A telemetry system in a vehicle, comprising:

(a) means defining an aperture in the rear of said vehicle for passage of a laser beam therethrough;

(b) laser means in said vehicle and means for projecting a beam from said laser through said aperture;

(c) means for pulsing said laser;

(d) means for coding the pulsing of said laser in one manner in the absence of a desired vehicle parameter condition; and (e) means for coding the pulsing of said laser differently in the presence of said condition.

9. Apparatus in accordance with claim 8 wherein said vehicle is adapted to be launched, and including means for energizing said laser pulsing means with operating power when activated, and automatic means for activating said energizing means responsive to launch of said vehicle.

10. A telemetry system in a flight vehicle, comprising:

(a) means defining an aperture in the rear of said vehicle for passage of a laser beam therethrough;

(b) laser means in said vehicle and means for projecting a beam from said laser through said aperture;

(c) a voltage controlled oscillator having an output connected to pulse said laser in accordance with the frequency of said voltage controlled oscillator; and (d) means for changing the input control voltage of said oscillator in accordance with the condition of a plurality of desired vehicle parameters during flight.

* * * * *